US007466839B2

(12) United States Patent
Yasugahira et al.

(10) Patent No.: US 7,466,839 B2
(45) Date of Patent: Dec. 16, 2008

(54) WATERPROOF VIBRATION PLATE FOR SPEAKER

(75) Inventors: Kichiro Yasugahira, Fuji (JP); Ken Takahashi, Osaka (JP)

(73) Assignee: OG Corporation, Osaka (JP)

( * ) Notice: Subject to any disclaimer, the term of this patent is extended or adjusted under 35 U.S.C. 154(b) by 390 days.

(21) Appl. No.: 10/584,036

(22) PCT Filed: Dec. 22, 2004

(86) PCT No.: PCT/JP2004/019214

§ 371 (c)(1),
(2), (4) Date: Jun. 22, 2006

(87) PCT Pub. No.: WO2005/064987

PCT Pub. Date: Jul. 14, 2005

(65) Prior Publication Data

US 2007/0137820 A1 Jun. 21, 2007

(30) Foreign Application Priority Data

Dec. 26, 2003 (JP) ..... 2003-433891

(51) Int. Cl.
*H04R 25/00* (2006.01)

(52) U.S. Cl. ..... 381/426; 381/428

(58) Field of Classification Search ..... 381/386, 381/423, 424, 425, 426, 428, 432; 181/163, 181/167, 169; 29/594, 609.1; 162/218, 158, 162/172, 180

See application file for complete search history.

(56) References Cited

U.S. PATENT DOCUMENTS

| | | | | | |
|---|---|---|---|---|---|
| 3,292,730 | A | * | 12/1966 | Moskow | 181/163 |
| 3,961,378 | A | * | 6/1976 | White | 29/594 |
| 5,168,527 | A | * | 12/1992 | Loya | 381/395 |
| 5,903,658 | A | * | 5/1999 | Okazaki et al. | 381/428 |

FOREIGN PATENT DOCUMENTS

| | | | |
|---|---|---|---|
| JP | 63-7000 | A | 1/1988 |
| JP | 4-324798 | A | 11/1992 |
| JP | 05-183985 | A | 7/1993 |
| JP | 2000-115885 | A | 4/2000 |

* cited by examiner

*Primary Examiner*—Huyen D Le
(74) *Attorney, Agent, or Firm*—The Webb Law Firm

(57) ABSTRACT

There is provided a speaker that uses a waterproof vibration plate that is obtained by forming a water repellent layer containing wax on a surface of paper pulp by the use of a wax-based emulsion in a suspension of the paper pulp, then forming a binder layer containing rosin or alkyl ketene dimmer on a surface of the water repellent layer by the use of a rosin sizing agent or an alkyl ketene dimmer sizing agent in the suspension, then forming an oil repellent layer containing a fluorinated resin on a surface of the binder layer by the use of a fluorine-based resin emulsion in the suspension, then forming the paper pulp into paper, and then heating and drying the same.

3 Claims, No Drawings

WATERPROOF VIBRATION PLATE FOR SPEAKER

FIELD OF THE INVENTION

The present invention relates to a speaker that is excellent in waterproof property and intended to be used for various audio equipments.

BACKGROUND OF THE INVENTION

Speakers used as car-door mounted speakers or the like are required to have waterproof property to such an extent as to prevent water intrusion into the inside of a vibration plate since there is a likelihood that rain water, a shampoo solution for car-wash or the like is splashed thereon when a door is opened or closed or a window is opened or closed during rain or car wash.

A mainly used method of manufacturing speakers having such waterproof property is a dipping method that includes forming paper pulp, which is suspended in an aqueous solution, into paper, molding it into a plate, and dipping it in a working fluid made of an organic solvent with a fluorinated resin dissolved therein.

However, the dipping method is required to separately carry out a step in which a subject is to be treated with oil, in addition to a paper-making step in which a subject is to be treated with water, which causes a problem of necessitating troublesome manufacturing procedures, as well as a problem of causing an environmental pollution or the like due to the use of the organic solvent for dissolving the fluorinated resin.

Furthermore, speakers as manufactured have a problem of providing only insufficient waterproof performance to a shampoo solution for car wash.

Patent Document 1 proposes a method of making paper by the use of paper pulp with an aqueous synthetic resin fixed thereto, which resin having a fluorine group at an end.

However, the problem of providing only insufficient waterproof performance to a shampoo solution for car wash has not yet been solved.

Therefore, there is a demand for speakers that can be easily manufactured, causing less environmental pollution, and exhibits satisfactory waterproof performance to a shampoo solution for car wash.

Patent Document 1: Official Gazette of Japanese Patent Application Laid-open No. Hei-5-183985

SUMMARY OF THE INVENTION

Problems to be Solved by the Invention

In consideration of the above problems, it is an object of the present invention to provide a speaker that can be easily manufactured, cause less environmental pollution and exhibit satisfactory waterproof performance to a shampoo solution for car wash.

Means of Solving the Problems

The present inventors made intensive investigations in order to solve the above problems and found that a fluorinated resin which can only be dissolved by an organic solvent enables application of waterproofing with water by being emulsified, and that it is possible to produce satisfactory waterproof performance to a shampoo solution for car wash by forming paper pulp, which has at least a water repellent layer, an oil repellent layer and a binder layer, into paper, and thus achieved the present invention.

Specifically, according to the present invention, there is provided a speaker, which is characterized by that it uses a waterproof vibration plate that is obtained by forming a water repellent layer containing wax on a surface of paper pulp by the use of a wax-based emulsion in a suspension of the paper pulp, then forming a binder layer containing rosin or alkyl ketene dimmer on a surface of the water repellent layer by the use of a rosin sizing agent or an alkyl ketene dimmer sizing agent in the suspension, then forming an oil repellent layer containing a fluorinated resin on a surface of the binder layer by the use of a fluorine-based resin emulsion in the suspension, then forming the paper pulp into paper, and then heating and drying the same.

Advantages of the Invention

A speaker of the present invention exhibits excellent waterproof performance not only to rain water or the like but also to a shampoo solution for car wash. That is, although a car wash shampoo usually contains, in addition to as a surfactant, low alcohol that dissolves wax of a water repellent layer, the oil repellent layer of the fluorinated resin formed on the surface prevents intrusion of the low alcohol and hence prevents the water repellent layer from being dissolved by the low alcohol.

With the speaker of the present invention, a waterproof speaker can be manufactured without the necessity to perform a treatment with oil separately after a paper forming step with water, so that it can be manufactured with ease and cause less environmental pollution since an organic solvent is not used.

BEST MODE FOR CARRYING OUT THE INVENTION

The description will be made for a speaker according to one embodiment of the present invention.

A speaker of the present invention uses a waterproof vibration plate that is obtained by forming a water repellent layer containing wax on a surface of paper pulp by the use of a wax-based emulsion in a suspension of the paper pulp, then forming a binder layer containing rosin or alkyl ketene dimmer on a surface of the water repellent layer by the use of a rosin sizing agent or an alkyl ketene dimmer sizing agent in the suspension, then forming an oil repellent layer containing a fluorinated resin on the binder layer by the use of a fluorine-based resin emulsion in the suspension, then forming the paper pulp into paper, and then heating and drying the same.

Now, the description will be made for materials and chemicals to be used in manufacturing the speaker of the present invention.

As paper pulp to be used in manufacturing a waterproof vibration plate, foreign pulp (NUKP (softwood unbleached Kraft pulp), NBKP (softwood bleached Kraft pulp)) or the like is mainly used.

It is possible to secondarily use, for example, SP pulp (sulfite pulp), Japan paper pulp, natural fibers or chemical fibers which are added to the foreign pulp.

A wax-based emulsion used as a water repellent agent that forms a water repellent layer is prepared by emulsifying wax; and examples of wax include paraffin wax, Candelilla wax, Carnauba wax, rice wax, montan wax, cerecine wax, microcrystalline wax, petrolactum, Fischer-Tropsch wax, polyethylene wax, montan wax and its derivatives, microcrystalline wax and its derivatives, hardened ricinus oil, adepsine oil and stearic acid amide.

Among them, preferable is a cationic wax-based emulsion with paraffin wax having a melting point of 40 to 90° C. forcedly emulsified.

A known technique may be used to prepare a wax-based emulsion, and for example, wax, resin and plasticizer are co-heated or heated after mixed, so as to be melted and fused together.

Examples of the resin to be used include rosin, esterification products of rosin such as maleinized rosin and fumarized rosin, polybutene and petroleum resin. Among them, rosin, esterification products of rosin, polybutene and the like are preferably used. Examples of the plasticizer to be used include polyalcohol and esterification products of polyalcohol. After melted and fused, an organic amine, ammonia, a surfactant, a styrene-maleic acid copolymer or the like is added and emulsified. Thus, the wax-based emulsion is produced.

Different kinds of the wax emulsion may be used solely or as a mixture of two or more of them.

The amount of the water repellent agent to be added (amount of solid content) is in a range from 3 to 15 wt. % and preferably in a range from 5 to 10 wt. %, relative to the bone-dry weight of pulp material.

With the water repellent agent added within the above ranges, a speaker as a molded product can be provided with waterproof property.

As an oil repellent agent for forming the oil repellent layer, it is possible to use one kind or a mixture of two or more kinds selected from a fluorine-based resin emulsion and a synthetic resin emulsion having a fluorine group at an end.

By the resin emulsions is meant an aggregate of resin particles dispersed in an aqueous medium, which is prepared by emulsion polymerization or forced emulsion, or a dispersion liquid itself.

As an example of the fluorinated resin that forms the fluorine-based resin emulsion, it can be cited a homopolymer of vinyl monomer or a copolymer with another monomer, containing a fluoroalkyl group, as well as various polymer molecules having a fluoro group bonded to a main chain, and the like.

Particularly, as the fluorine-based resin emulsion, a perfluoroacrylate copolymer emulsion is preferably used.

The amount of the oil repellent agent to be added (amount of solid content) is in a range from 0.2 to 10 wt. % and preferably in a range from 0.5 to 3 wt. %, relative to the bone-dry weight of pulp material.

With the oil repellent agent added in the above ranges, a speaker as a molded product can be provided with resistance characteristics against a surfactant, low alcohol or the like contained in a shampoo solution for car wash.

As a binder agent for forming the binder layer, it is possible to use one kind or a mixture of two or more kinds selected from a rosin sizing agent or a synthetic high polymer sizing agent.

As the rosin sizing agent, potassium salt of rosin is preferably used.

The rosin sizing agent has a rosin material that may be dissolved or dispersed in water, and includes an aqueous rosin sizing agent neutralized by alkali or an emulsion rosin sizing agent emulsified by various surfactants or a water-soluble high polymer. Examples of the rosin material include rosins such as gum rosin, wood rosin, tall oil rosin, hydrogenerted rosin, disproportionating rosin, polymerized rosin, aldehyde-modified rosin and rosin ester; and reaction products of these rosins with α,β-unsaturated carboxylic acid such as acrylic acid, maleic anhydride, fumaric acid and itaconic acid. Examples of the surfactant or water-soluble high polymer for use in the emulsion rosin sizing agent include an alkali neutralized product of the rosin material; alkylbenzenesulfonic acid salt, monoalkylsulfate ester salt, polyethylene glycol, polyoxyethylene alkyl ether, polyoxyethylene alkyl phenyl ether, polyoxyethylene alkyl ether sulfate ester salt, polyoxyethylene alkyl ether sulfonic ester salt, polyoxyethylene alkyl ether sulfosuccinate ester salt, polyvinyl alcohol, polyacrylamide, a copolymer of a hydrophobic monomer such as styrenes or a low alkyl ester of (meth)acrylic acid and an anionic monomer such as (meth)acrylic acid; shellac; and casein.

As the high polymer sizing agent, it can be cited an alkyl ketene dimer sizing agent.

The alkyl ketene dimer sizing agent may be manufactured usually by emulsifying alkyl ketene dimmer, which is manufactured by dimerizing a corresponding, saturated fatty acid chloride having a carbon number of about 6 to 24 by the treatment with a base such as triethylamine.

The alkyl ketene dimmer is represented by the following formula (1).

[Formula 1]

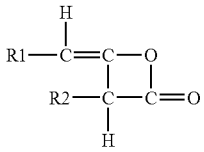

(1)

In the alkyl ketene dimmer represented by the formula (1), R1 and R2 each represent a hydrocarbon radical having a carbon number of 6 to 24.

Examples of the hydrocarbon radical include alkyl, alkenyl and the like. Examples of alkyl include hexyl, heptyl, octyl, isooctyl, nonyl, isononyl, decyl, isodecyl, undecyl, dodecyl, tridecyl, isotridecyl, tetradecyl, isotetradecyl, pentadecyl, isopentadecyl, hexadecyl, isohexadecyl, heptadecyl, isoheptadecyl, ocadecyl, nonadecyl, isononadecyl, eicocyl, isoeicocyl, henicosyl, isohenicosyl, docosyl, isodocosyl, tricosyl, isotricosyl, tetracosyl and isotetracosyl. Examples of alkenyl include tetradecenyl, hexadecenyl, octadecenyl, eicocenyl and dococenyl.

Among them, preferable is a hydrocarbon radical having a carbon number of 8 to 20, and more preferable is a hydrocarbon radical having a carbon number of 10 to 18. With the carbon number being less than 6, sizing immediately after the preparation is not sufficiently made, and with the carbon number being more than 24, a resulting composition has an increased viscosity and hence is gelated, causing undesirable deterioration in sizing capability, and therefore these are not preferable.

The amount of the binder agent to be added is in a range from 0.5 to 9 wt. % and preferably in a range from 1 to 4 wt. %, relative to the bone-dry weight of pulp material.

With the binder agent within the above ranges, it functions to bind the water repellent layer and the oil repellent layer.

When the water repellent agent, the oil repellent agent and the binder are used in combination, it is preferable to combine a cationic paraffin wax emulsion as the water repellent agent, a perfluoroacrylate copolymer emulsion as the oil repellent agent, and a rosin- or alkyl ketene dimmer-based sizing agent as the binder agent.

Now, the description will be made for a method of manufacturing the speaker of the present invention.

The speaker of the present invention is manufactured by the use of a waterproof vibration plate.

The waterproof vibration plate is obtained by forming a water repellent layer containing wax on a surface of paper pulp by the use of a wax-based emulsion in a suspension of the paper pulp, then forming a binder layer containing rosin on a surface of the water repellent layer by the use of a rosin sizing agent in the suspension, then forming an oil repellent layer containing a fluorinated resin on a surface of the binder by the use of a fluorine-based resin emulsion in the suspension, then forming the paper pulp into paper, and then heating and drying the same.

The description will be made hereinafter for a method of manufacturing the waterproof vibration plate.

First, paper pulp is added into an aqueous medium, and stirred to prepare a paper pulp suspension.

Dye for dying the pulp, such as an azo direct dye, is added into the paper pulp suspension, thereby dying the paper pulp, and a fixing agent (FIX) for fixing the dye color is added thereto. A dying step may be omitted.

Then, a treatment for adding a water-soluble resin or the like, which gives water-resisting property to the paper pulp, is carried out, so that the paper pulp is given a certain degree of water-resisting property. This treatment allows the paper pulp to have a certain degree of water-resisting property, but has not yet allow the same to have satisfactory waterproof property.

Then, a water repellent agent of a cationic paraffin wax emulsion with a concentration adjusted to a given level is added to the paper pulp suspension.

Fine particles of the cationic paraffin wax emulsion attach onto fibers of the paper pulp by the addition of the water repellent agent, and thus the water repellent layer is formed.

A rosin sizing agent with a concentration adjusted to a given level is added to the paper pulp suspension with the water repellent layer formed therein, and thus a binder layer is formed on a surface of the water repellent layer.

The binder layer functions to bind the water repellent layer and a hereinafter-described oil repellent layer.

An alkyl ketene dimmer sizing agent may be used in place of the rosin sizing agent.

A fluorine-based resin emulsion (an oil repellent agent) with a concentration adjusted to a given level is added to the paper pulp suspension with the binder layer formed therein, and thus an oil repellent layer is formed on a surface of the binder layer.

Fine particles of the fluorine-based resin emulsion attach onto the binder layer by the addition of the oil repellent agent, and thus the oil repellent layer is formed.

That is, since the binder layer is formed on the surface of the paper pulp even in the aqueous medium, an interaction between the binder layer and the fluorine-based resin emulsion causes the fluorine-based resin emulsion to attach onto the binder layer, and thus the oil repellent layer is formed.

Finally, aluminum sulfate as a sizing agent is added to the paper pulp suspension and thus a liquid raw material for paper making is obtained.

The thus obtained raw water for paper making is molded by a wire mesh base having a shape of a vibration plate and thus an intermediate of molded paper is obtained.

Water contained in the intermediate of molded paper is removed by heating.

The heating temperature is preferably in a range from 50 to 250° C. and more preferably in a range from 160 to 210° C.

With the temperature being less than 50° C., chemicals may be poorly fixed.

With the temperature being more than 250° C., separation between chemicals and pulp may occur.

The paper pulp with the water repellent layer, the binder layer and the oil repellent layer formed therein is heated and molded so that the layers respectively formed on fibers of the paper pulp are melted and fused together, thus forming a rigid coating.

The outermost oil repellent layer is resistant to low alcohol and water contained in a shampoo solution for car wash, and therefore prevents intrusion of low alcohol and water.

The underlying water repellent layer further prevents intrusion of water. Thus, it is possible to maintain sufficient water resistance against a shampoo solution for car wash thanks to the respective layers.

A molded product of a vibration plate having a desirable shape may be obtained by forming a liquid raw material for paper making into paper by a metal mesh formed into a shape of a cone-shaped vibration plate, evaporating water, heating, pressing and drying the paper in heated male and female dies which together have a shape of the vibration plate.

The heating temperature is preferably in a range from 50 to 250° C. and more preferably in a range from 160 to 210° C.

The pressure applied is preferably in a range from 2 to 5 $kg/cm^2$.

A speaker is manufactured by shaping and processing the vibration plate thus obtained by the manufacturing method.

The speaker is unlikely to deteriorate its waterproof property and hence the quality of sound, the volume and the like as emitted therefrom even when a shampoo solution for car wash is splashed thereon, since the speaker uses the waterproof vibration plate having excellent waterproof property.

EXAMPLES

The present invention will be described by citing the following examples, which are not intended to limit the present invention.

(Method of Measuring and Testing Water Absorptiveness)

Measuring and testing of the water absorbency were carried out according to JIS P 8140 (Measuring of the water absorptiveness by a Cobb method).

Example 1

Softwood unbleached Kraft pulp (pulp material) was beaten in an aqueous medium to have the Canadian freeness of 600 cc; then a dye, a fixing agent and a sizing agent as respectively predetermined were added thereto; then a cationic paraffin wax emulsion ("COATCYZER MS-365", manufactured by Daiwa Chemical Industries Co., Ltd.) as a water repellent agent was added in the amount of 5 wt. % relative to the bone-dry weight of pulp material; and then they were stirred. Then, rosin potassium salt ("HARSIZE L-50, manufactured by Harima Chemicals, Inc.) as a binder agent was added in the amount of 1 wt. % relative to the bone-dry weight of pulp material and they were stirred. Further, a perfluoroacrylate copolymer emulsion ("COATCYZER DCF", manufactured by Daiwa Chemical Industries Co., Ltd.) as an oil repellent agent was added in the amount of 0.5 wt. % relative to the bone-dry weight of pulp material and they were stirred. Then, a given amount of aluminum sulfate was added to pulp slurry and they were stirred.

This slurry was formed into paper by a metal mesh molded into a shape of a cone-shaped vibration plate; water was removed; then the slurry was heated, pressed and dried under a pressure of 3.5 $kg/cm^2$ within male and female dies having a shape of the vibration plate and heated at 180° C.; and thus a molded product of a vibration plate having a desirable shape was obtained.

The water absorptiveness of the thus obtained molded product was measured by the use of the method of measuring and testing water absorptiveness. As a result, the water absorptiveness was 150.

Example 2

A molded product of a vibration plate was obtained by following the same procedures as those of Example 1 except that there were used a cationic paraffin wax emulsion ("COATCYZER MS-365", manufactured by Daiwa Chemical Industries Co., Ltd.) as a water repellent agent in the amount of 3.6 wt. % relative to the bone-dry weight of pulp material; rosin potassium salt ("HARSIZE L-50, manufactured by Harima Chemicals, Inc.) as a binder agent in the amount of 0.6 wt. % relative to the bone-dry weight of pulp material; and a perfluoroacrylate copolymer emulsion ("COATCYZER DCF", manufactured by Daiwa Chemical Industries Co., Ltd.) as an oil repellent agent in the amount of 0.9 wt. % relative to the bone-dry weight of pulp material.

The water absorptiveness of the thus obtained molded product was measured by the use of the method of measuring and testing water absorptiveness. As a result, the water absorptiveness was 165.

Example 3

A molded product of a vibration plate was obtained by following the same procedures as those of Example 1 except that there were used a cationic paraffin wax emulsion ("COATCYZER MS-365", manufactured by Daiwa Chemical Industries Co., Ltd.) as a water repellent agent in the amount of 3.6 wt. % relative to the bone-dry weight of pulp material; alkyl ketene dimmer ("DIMER S-20, manufactured by Daiwa Chemical Industries Co., Ltd.) as a binder agent in the amount of 0.6 wt. % relative to the bone-dry weight of pulp material; and a perfluoroacrylate copolymer emulsion ("COATCYZER DCF", manufactured by Daiwa Chemical Industries Co., Ltd.) as an oil repellent agent in the amount of 0.9 wt. % relative to the bone-dry weight of pulp material.

The water absorptiveness of the thus obtained molded product was measured by the use of the method of measuring and testing water absorptiveness. As a result, the water absorptiveness was 160.

Example 4

A molded product of a vibration plate was obtained by following the same procedures as those of Example 1 except that there were used a cationic paraffin wax emulsion ("COATCYZER MS-365", manufactured by Daiwa Chemical Industries Co., Ltd.) as a water repellent agent in the amount of 6.0 wt. % relative to the bone-dry weight of pulp material; rosin potassium salt ("HARSIZE L-50, manufactured by Harima Chemicals, Inc.) as a binder agent in the amount of 1.2 wt. % relative to the bone-dry weight of pulp material; and a perfluoroacrylate copolymer emulsion ("COATCYZER DCF", manufactured by Daiwa Chemical Industries Co., Ltd.) as an oil repellent agent in the amount of 2.0 wt. % relative to the bone-dry weight of pulp material.

The water absorptiveness of the thus obtained molded product was measured by the use of the method of measuring and testing water absorptiveness. As a result, the water absorptiveness was 125.

Example 5

A molded product of a vibration plate was obtained by following the same procedures as those of Example 1 except that there were used a cationic paraffin wax emulsion ("COATCYZER MS-365", manufactured by Daiwa Chemical Industries Co., Ltd.) as a water repellent agent in the amount of 6.0 wt. % relative to the bone-dry weight of pulp material; alkyl ketene dimmer ("DIMER S-20", manufactured by Daiwa Chemical Industries Co., Ltd.) as a binder agent in the amount of 1.2 wt. % relative to the bone-dry weight of pulp material; and a perfluoroacrylate copolymer emulsion ("COATCYZER DCF", manufactured by Daiwa Chemical Industries Co., Ltd.) as an oil repellent agent in the amount of 2.0 wt. % relative to the bone-dry weight of pulp material.

The water absorptiveness of the thus obtained molded product was measured by the use of the method of measuring and testing water absorptiveness. As a result, the water absorptiveness was 130.

Comparative Example 1

A dye, a fixing agent and a sizing agent as respectively predetermined were added in the same amounts as those of Example 1 to softwood unbleached Kraft pulp (pulp material), and then a perfluoroacrylate copolymer emulsion as an oil repellent agent was added in the amount of 0.5 wt. % relative to the bone-dry weight of pulp material and they were stirred. Then, rosin potassium salt as a binder agent was added in the amount of 1 wt. % relative to the bone-dry weight of pulp material and they were stirred. Then, a cationic paraffin wax emulsion as a water repellent agent was added in the amount of 5 wt. % relative to the bone-dry weight of pulp material, and then they were stirred. Then, aluminum sulfate was added to pulp slurry in the same manner as Example 1.

A molded product of a vibration plate was obtained by the use of the same method as that of Example 1 for the following procedures.

The water absorptiveness of the thus obtained molded product was measured by the use of the method of measuring and testing water absorptiveness. As a result, the water absorptiveness was 175.

Comparative Example 2

A dye, a fixing agent and a sizing agent as respectively predetermined were added in the same amounts as those of Example 1 to softwood unbleached Kraft pulp (pulp material), and then rosin potassium salt as a binder agent was added in the amount of 1 wt. % relative to the bone-dry weight of pulp material and they were stirred. Then, a perfluoroacrylate copolymer emulsion as an oil repellent agent was added in the amount of 0.5 wt. % relative to the bone-dry weight of pulp material and they were stirred. Then, aluminum sulfate was added to pulp slurry in the same manner as Example 1.

A molded product of a vibration plate was obtained by the use of the same method as that of Example 1 for the following procedures.

The water absorptiveness of the thus obtained molded product was measured by the use of the method of measuring and testing water absorptiveness. As a result, the water absorptiveness was 285.

Comparative Example 3

A dye, a fixing agent and a sizing agent as respectively predetermined were added in the same amounts as those of Example 1 to softwood unbleached Kraft pulp (pulp material), and then a cationic paraffin wax emulsion as a water repellent agent was added in the amount of 5 wt. % relative to the bone-dry weight of pulp material and they were stirred. Then, rosin potassium salt as a binder agent was added in the amount of 1 wt. % relative to the bone-dry weight of pulp material and they were stirred. Then, aluminum sulfate was added to pulp slurry and stirred in the same manner as Example 1.

A molded product of a vibration plate was obtained by the use of the same method as that of Example 1 for the following procedures.

The water absorptiveness of the thus obtained molded product was measured by the use of the method of measuring and testing water absorptiveness. As a result, the water absorptiveness was 388.

The order in which the respective chemicals were added, the amount of each of the chemicals added, which chemicals were used in the Examples 1 to 3, and the results of the measurement of the water absorptiveness are shown in Table 1.

TABLE 1

| ADDING ORDER | WATER REPELLENT AGENT | BINDER AGENT (*1) | OIL REPELLENT AGENT | MEASURED WATER ABSORPTIVENESS |
|---|---|---|---|---|
| EXAMPLE 1 | 5 WT. % | 1 WT. % | 0.5 WT. % | 150 |
| EXAMPLE 2 | 3.6 WT. % | 0.6 WT. % | 0.9 WT. % | 165 |
| EXAMPLE 3 | 3.6 WT. % | 0.6 WT. % | 0.9 WT. % | 160 |
| EXAMPLE 4 | 6.0 WT. % | 1.2 WT. % | 2.0 WT. % | 125 |
| ADDING ORDER | WATER REPELLENT AGENT | BINDER AGENT (*2) | OIL REPELLENT AGENT | MEASURED WATER ABSORPTIVENESS |
| EXAMPLE 5 | 6.0 WT. % | 1.2 WT. % | 2.0 WT. % | 130 |
| ADDING ORDER | OIL REPELLENT AGENT | BINDER AGENT (*1) | WATER REPELLENT AGENT | MEASURED WATER ABSORPTIVENESS |
| COMPARATIVE EXAMPLE 1 | 0.5 WT. % | 1 WT. % | 5 WT. % | 175 |
| ADDING ORDER | — | BINDER AGENT (*1) | OIL REPELLENT AGENT | MEASURED WATER ABSORPTIVENESS |
| COMPARATIVE EXAMPLE 2 | — | 1 WT. % | 0.5 WT. % | 285 |
| ADDING ORDER | WATER REPELLENT AGENT | BINDER AGENT (*1) | — | MEASURED WATER ABSORPTIVENESS |
| COMPARATIVE EXAMPLE 3 | 5 WT. % | 1 WT. % | — | 388 |

(*1): ROSIN SIZING AGENT
(*2): ALKYL KETENE DIMMER SIZING AGENT (Results of the Measuring and Testing of the Water Absorptiveness)

In the Comparative Example 1 with the adding order replaced, the water absorptiveness was increased about 15% compared with the Example 1 and thus the waterproof property was deteriorated.

In the Comparative Example 2 with no water repellent agent added, the water absorptiveness was increased about twice that of the Example 1 and thus the waterproof property was deteriorated.

In the Comparative Example 3 with no oil repellent agent added, the water absorptiveness was increased about 2.5 times that of the Example 1 and thus the waterproof property was deteriorated.

Further, in each of the Examples 4 and 5, the water absorptiveness was 150 or less and thus it was confirmed that a high waterproof performance is exhibited.

(Performance Evaluation Test)

A vibration plate prepared in each of the Example 1 to the Comparative Example 3 are tightly secured to a bottom of a cylinder having a diameter of 7 cm.

A solution of 5 wt. % of car wash shampoo was added to the cylinder to reach a depth of 10 cm, and left to stand for 72 hours upon confirmation of no leakage of the solution through the bottom. Visual observation was made to confirm whether there occurred permeation of solution droplet or leakage.

As a result, there occurred no solution leakage through each of the vibration plates prepared in the Examples 1 to 5 even when they were left to stand for 72 hours.

In the Comparative Examples 1 to 3, solution leakage was observed.

The invention claimed is:

1. A speaker comprising a waterproof vibration plate that is obtained by forming a water repellent layer containing wax on a surface of paper pulp by the use of a wax-based emulsion in a suspension of the paper pulp, then forming a binder layer containing rosin or alkyl ketene dimmer on a surface of the water repellent layer by the use of a rosin sizing agent or an alkyl ketene dimmer sizing agent in the suspension, then forming an oil repellent layer containing a fluorinated resin on a surface of the binder layer by the use of a fluorine-based resin emulsion in the suspension, then forming the paper pulp into paper, and then heating and drying the same.

2. A method of manufacturing a waterproof vibration plate, comprising the steps of forming a water repellent layer containing wax on a surface of paper pulp by the use of a wax-based emulsion in a suspension of the paper pulp, then forming a binder layer containing rosin or alkyl ketene dimmer on a surface of the water repellent layer by the use of a rosin sizing agent or an alkyl ketene dimmer sizing agent in the suspension, then forming an oil repellent layer containing a fluorinated resin on a surface of the binder layer by the use of a fluorine-based resin emulsion in the suspension, then forming the paper pulp into paper, and then heating and drying the same.

3. A waterproof vibration plate for speaker, manufactured by a process comprising the steps of forming a water repellent layer containing wax on a surface of paper pulp by the use of a wax-based emulsion in a suspension of the paper pulp, then forming a binder layer containing rosin or alkyl ketene dimmer on a surface of the water repellent layer by the use of a rosin sizing agent or an alkyl ketene dimmer sizing agent in the suspension, then forming an oil repellent layer containing a fluorinated resin on a surface of the binder layer by the use of a fluorine-based resin emulsion in the suspension, then forming the paper pulp into paper, and then heating and drying the same.

* * * * *